US006045329A

United States Patent [19]

Sobala

[11] Patent Number: 6,045,329

[45] Date of Patent: Apr. 4, 2000

[54] FAN FILTER

[76] Inventor: Randy Sobala, 5064 Forestwalk Drive, Mississauga, ON, Canada, L4Z 4A2

[21] Appl. No.: 09/092,932

[22] Filed: Jun. 8, 1998

[51] Int. Cl.[7] ..... F04D 29/70

[52] U.S. Cl. ..... 416/146 R; 416/247 R; 417/423.9; 55/471

[58] Field of Search ..... 416/146 R, 247 R, 416/62; 417/423.9; 415/121.2; 55/467, 471; 150/154, 157, 165

[56] References Cited

U.S. PATENT DOCUMENTS

| | | | |
|---|---|---|---|
| 1,489,704 | 4/1924 | Kleshick | 150/165 |
| 2,035,384 | 3/1936 | Hinchliff | 150/154 |
| 2,161,027 | 6/1939 | Dollinger | 55/471 |
| 2,453,009 | 11/1948 | Ganger et al. | 416/247 R |
| 2,812,900 | 11/1957 | Matthews | 416/146 R |
| 2,923,463 | 2/1960 | Shunkwiler | 416/247 R |
| 3,737,171 | 6/1973 | Becker | 150/154 |
| 3,766,954 | 10/1973 | Gentellalli | 150/154 |
| 4,336,040 | 6/1982 | Haberl . | |
| 4,467,494 | 8/1984 | Jones . | |
| 4,477,272 | 10/1984 | Hollis et al. | 55/471 |
| 4,581,050 | 4/1986 | Krantz . | |
| 4,703,152 | 10/1987 | Shih-Chin | 416/100 |
| 4,715,872 | 12/1987 | Snyder . | |
| 4,750,863 | 6/1988 | Scoggins . | |
| 5,001,807 | 3/1991 | Arai . | |
| 5,059,224 | 10/1991 | Kikkawa et al. . | |
| 5,094,676 | 3/1992 | Karbacher . | |
| 5,305,907 | 4/1994 | Richardson et al. | 150/154 |
| 5,453,049 | 9/1995 | Tillman, Jr. et al. . | |
| 5,567,230 | 10/1996 | Sinclair . | |
| 5,603,741 | 2/1997 | Frey . | |
| 5,868,189 | 2/1999 | Jarvis | 150/165 |

*Primary Examiner*—Christopher Verdier
*Attorney, Agent, or Firm*—Eugene J. A. Gierczak

[57] ABSTRACT

A filter for a fan comprising air permeable material exteriorally embracing the suction portion of said fan.

16 Claims, 4 Drawing Sheets

FAN FILTER

FIELD OF INVENTION

This invention relates generally to a filter for a fan exteriorally embracing the suction portion of the fan and more particularly to a dust filtration shroud for use with an oscillating fan.

BACKGROUND ART

Various dust filtration devices for filtering air-born particles heretofore have been designed and manufactured whether used in portable dust filtration machines, filtration assemblies for ceiling fans or as filtering assemblies used in connection with the fan and a window.

Such filtering devices are important to prevent the recirculation of dust laden particles.

For example, U.S. Pat. No. 4,715,872 discloses a portable dust collector having a rigid body which is particularly adapted for collecting wood dust and wood chips. Said portable dust collector comprises a housing having an outer side wall, a substantially open top, a substantially open bottom, and a dust-proof chamber within an interior thereof: a motor enclosed within said chamber; blower means driven by said motor for drawing air into said housing, said blower means being enclosed with said interior and having an inlet extending through said housing and communicating with an exterior thereof, and an outlet discharging within said housing; said chamber and blower means being shaped to form a passageway within said chamber between said open top and bottom; filter bag means attached to and enclosing said top for retaining particulates discharged into said interior by said blower while allowing air to pass therethrough; collection bag means attached to and enclosing said bottom for collecting particulates retained in said interior of said housing, whereby particulate-laden discharged from said outlet circulates in the vicinity of said collection bag means and also flows through said passageway to said filter bag means; and support means to an extending downwardly from said housing side wall for providing clearance below said housing sufficient for said collection bag.

U.S. Pat. No. 4,581,050 discloses a dust collector having a rigid body that is adapted to filter both fine and coarse air-born particles. Said dust collector includes two tubes which communicate through an interconnecting conduit. A first tube operates a cyclone which separates a great fraction of the dust or solid components from the incoming air and collects the same in a bag at the bottom of the tube. The second tube includes a filter unit composed of a coarser filter as well as a surrounding fine filter, the filter unit receiving the pre-purified air from the cyclone tube through the interconnecting conduit and separating the remaining dust particles therefrom.

U.S. Pat. No. 4,336,040 discloses a dust separator having a rigid housing which comprises a fan with a drive motor; cyclone separator, which is connected to the suction side of the fan and is arranged as a coarse separator and provided with an inlet for gaseous fluid mixed with dust; filter which projects freely coaxially into the cyclone apparatus and is arranged as a fine separator between the interior of the cyclone apparatus and the suction side of the fan; and outlet for cleaned gaseous fluid at the pressure side of the fan.

U.S. Pat. No. 5,094,676 utilizes a conventional ceiling fan to pull air downwardly through a filter medium. The fan and filter assembly comprising said invention has a motor and an upstanding tubular member above the motor which carries electrical wires to the motor. A collar concentrically positioned on the tubular member includes radially extending support members, each of which supports a radially extending horizontal arm. At the end of each such arm is attached, a vertically extending support member. A shallow cylindrical shroud is carried on the vertically extending support members, with the shroud extending a limited distance above the radially extending arms. A plurality of trays having porous bottoms are supported on the arms and contain a filter medium including a layer of activate charcoal granules covered by a membrane of polyester filaments.

U.S. Pat. No. 4,750,863 also discloses a filter device for use in conjunction with a ceiling fan for removal of smoke and other pollutants from the room during the operation of the fan. Said invention comprises a filter media frame comprising two interconnectable open topped halves having means adapted to fit abuttingly around the tubular conduit of a ceiling an, said frame having means thereon for retaining a filter.

It is an object of this invention to provide an improved filter for a fan.

One aspect of this invention resides in a filter for a fan comprising an air permeable material exteriorally bracing the suction portion of the fan.

It is another aspect of this invention to provide a filter for a circulating fan having a safety cage and a stand connected to the suction portion of the fan comprising: a web of air permeable material presenting two opposite ends connected to one another so as to define a first and second opening; elastic means associated with each said first and second opening; whereby said air permeable material and said first and second opening are adapted to stretch over said fan, with said first opening elastically embracing said suction portion of said fan adjacent said stand and said other opening elastically embracing said safety cage of said fan.

BRIEF DESCRIPTION OF DRAWINGS

These and other objects and features of the invention shall now be described in relation to the following drawings.

BEST MODE FOR CARRYING OUT THE INVENTION

Figure 1A:
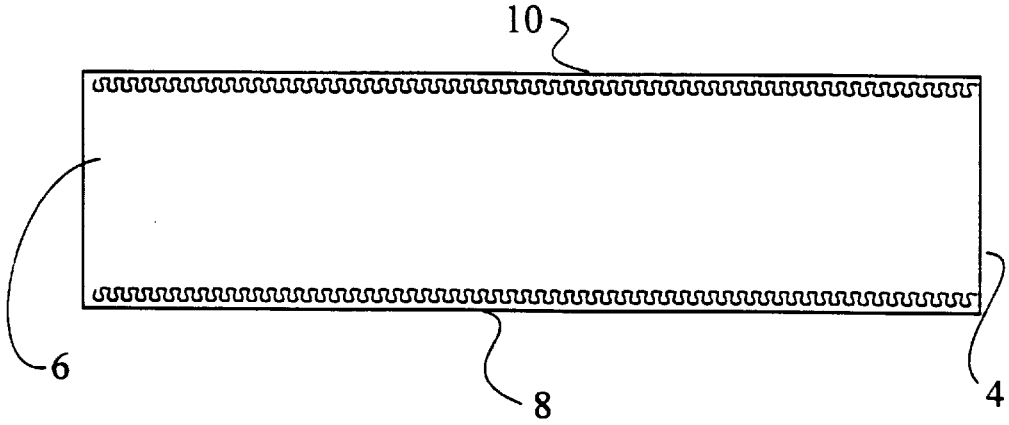
FIGS. 1*a* and 1*b* are a top land view and a perspective view of the filter.

In the description which follows, like parts are marked throughout the specification and the drawings with the same respective reference numerals. The drawings are not necessarily to scale and in some instances proportions may have been exaggerated in order to more clearly depict certain features of the invention.

Like parts will contain like numbers throughout the figures.

Figure 1B:
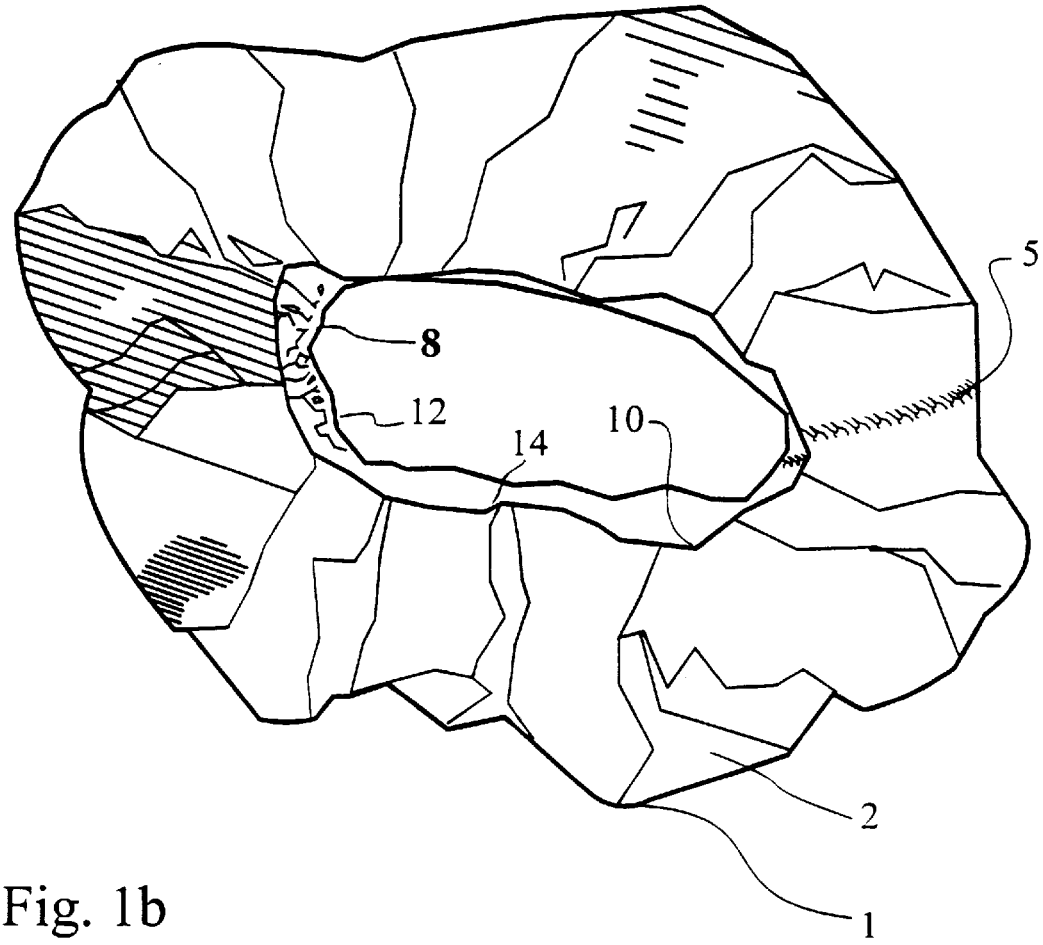

FIG. 1 generally illustrates the filter 2. The filter 2 comprises air permeable material which when used is adapted to entrain air laden particles in a manner to be described herein.

Although the air permeable material can be composed of a variety of materials, in one embodiment, the air permeable material consists of spunbonded polypropylene fabric having the following specification:

| | | |
|---|---|---|
| Weight | 0.50 | oz/sq yd |
| Thickness | 4.1 | mil (measured by ASTM DI 910 standards) |
| Tensile Strength | 10.8 | MD lbs |
| | 6.0 | CD lbs (measured by ASTM DI 882 standards) |
| Elongation | 80.0 | MD % |
| | 106.0 | CD % (measured by ASTM DI 882 standards) |
| Trapezoid | | |
| Tear - Peak MD lbs | 5.8 | |
| Avg MD lb | 4.1 | |
| Peak CD lb | 4.1 | |
| Avg CD lb | 2.7 | (measured by ASTM D 2283 standards) |
| Air Permeability | 880.0 | CuFt/sq ft/min (measured by ASTM D737-75 standards) |
| Mulien Burst | 46.0 | PSC (measured by ASTM D3766-90A) |

The filter 2 in one embodiment comprises a web of material which can be rectangular in shape so as to present a first end 4 and a second end 6 which are adapted to be stitched or connected together 5 so as to present an endless loop or continuous web of air permeable material which defines a first opening or perimetrical edge 8 and second opening or perimetrical edge 10. Each of the openings 8 and 10 having stitched thereto a strip of elastic material 12 and 14, respectively, which causes the openings 8 and 10 to expand and contract in size by stretching or relaxing the elastic material 8 and 10. Generally speaking, the filter 2 shown in FIG. 1 presents a deformable or flexible filter which can be stretched so as to present an air permeable material which is stitched together to present a continuous web or circular piece of material with stretchable openings at opposite ends, one end which is adapted to embrace the motor adjacent the intake portion of the cage and the other opening adapted to embrace an outer edge of the cage.

Figure 2:
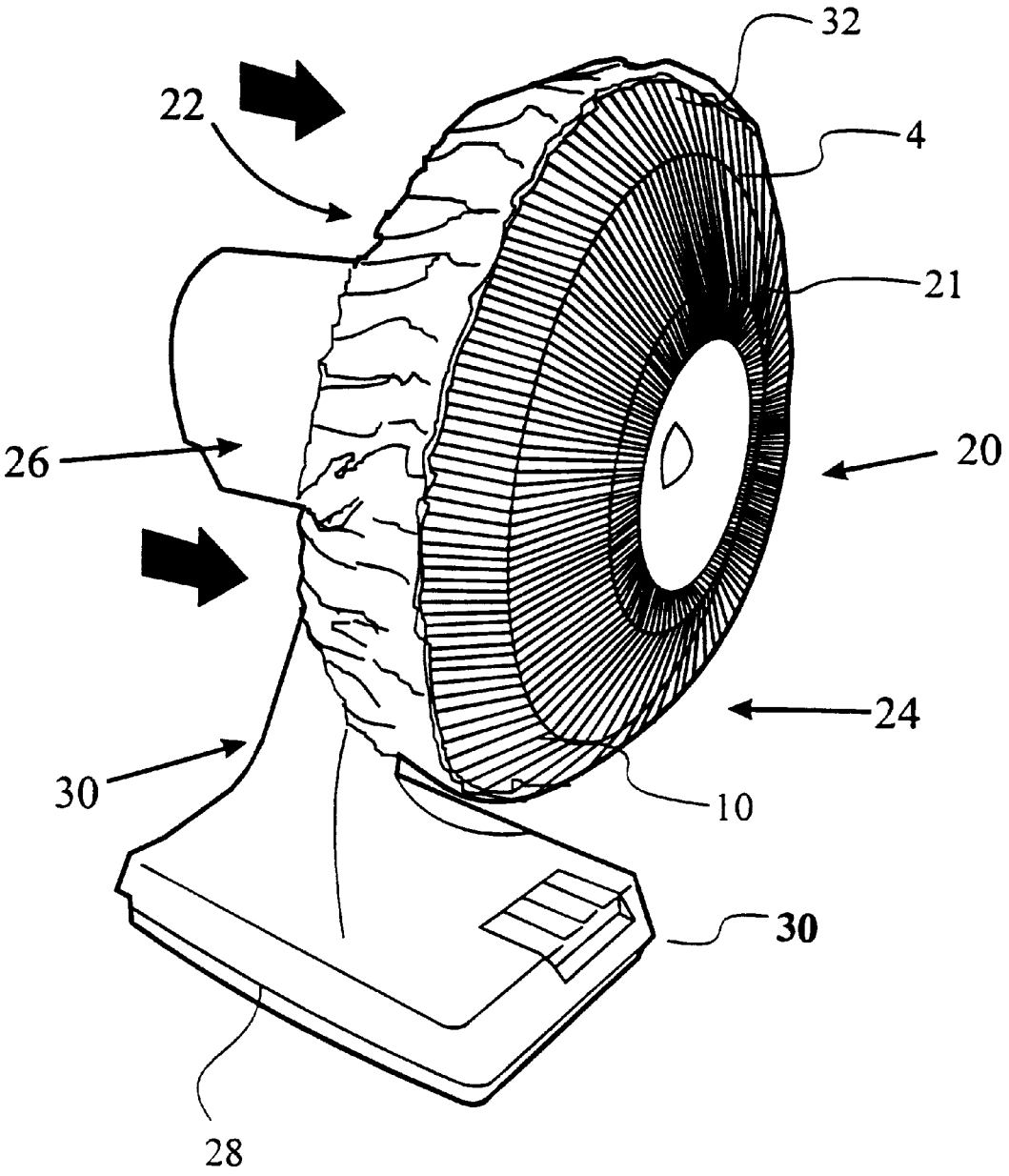
FIG. 2 is a perspective view of an oscillating fan with said filter mounted thereon.
Figure 3:
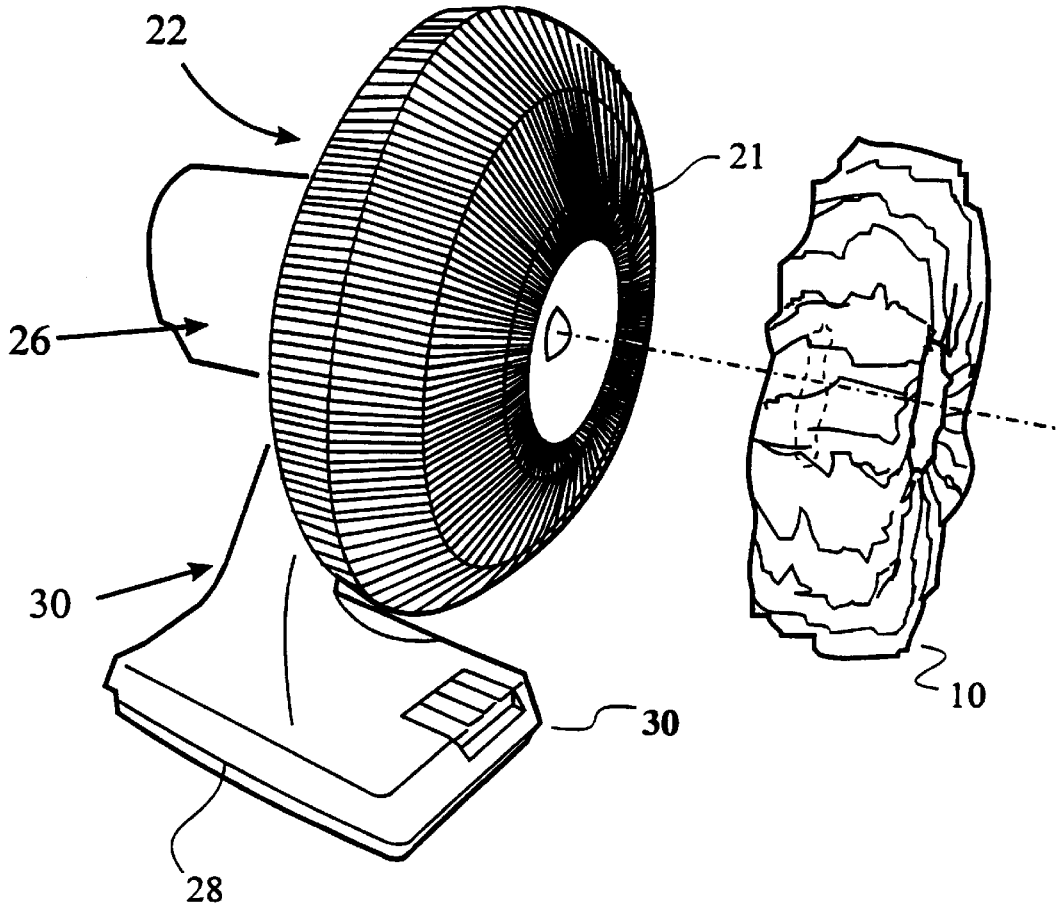
FIG. 3 is a perspective view of an oscillating fan.
Figure 4:
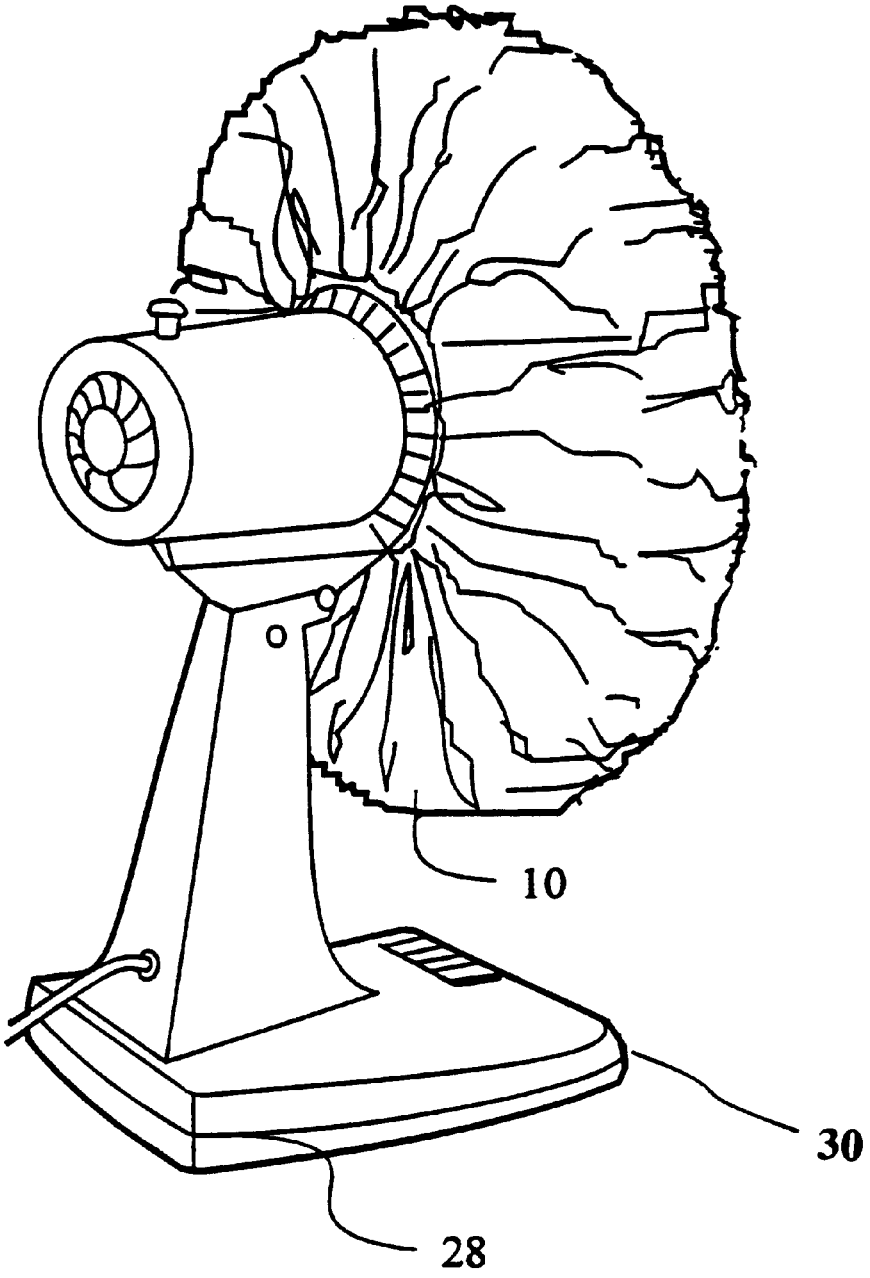
FIG. 4 is a rear view of the invention.

The filter 2 as described in FIG. 1, is adapted to be used in association with a fan. For example, FIG. 2 illustrates a circular or oscillating fan 20 having a circular cage 21 which presents a suction or inlet portion 22 and an exhaust or outlet portion 24. The circular fan 20 presents a plurality of blades 26 which are connected in a well known fashion to motor means [not shown] which cause the fan blades 26 to circulate creating a low pressure zone in the suction portion 22 thereby causing air to flow through the fan out the outlet 24. The circular fan 20 also presents a stand 28 which includes an appropriate pedestal 30 connected in a well known fashion to motor means 26 of the fan.

The filter 2 shown in FIG. 1, and in particular openings 8 and 10, are adapted to stretch over the periphery 32 of the circular fan 20 so as to stretch over same when mounting the filter 2 in the first position. Thereafter the stretched openings 8 and 10 may be relaxed whereby one opening 8, and in particular the elastic material 12, will relax so as to gather around the connection of the pedestal 30 to the suction portion 22 of the fan. The other opening 10 will relax so as to just stretch over the outer circumference 32 of fan 20 so that the air permeable material will cover the suction portion 22 of the fan.

Accordingly, with the filter 2 attached in the operable position, air travelling through the filter material will have any dust laden particulate trapped in the filter material so that the circulating air through the fan will be cleaner than if the filter is not used.

The air permeable material is endurable enough so that the filter may be washed or cleaned so as to remove collected particulates so as to re-use the filter material.

The elastic material 12 and 14 can comprise of elastic material generally used in fabrics, although other removable securing means could be used as, for example, using hook pile and loop pile means such as sold under the trademark "Velcro".

The filter 2 can comprise of a variety of shapes so long as the filter material exteriorally embraces the suction portion of the safety cage of a fan. For example, the filter 2 could be used to exteriorally embrace the suction portion of a square fan. Such square fans may not include a pedestal portion as the square fans generally lie along its bottom along the floor or the like. Accordingly, the filter may in such case include only one opening to exteriorally embrace the suction portion of square fan and reach over the periphery of the square fan.

It will be apparent to those skilled in the art that in light of the foregoing disclosure, many alterations and modifications are possible in the practice of this invention without departing from the spirit or scope thereof. Accordingly, the scope of the invention is to be construed in accordance with the substance defined in the following claims.

I claim:

1. A filter for a fan, said fan presenting a suction portion and exhaust portion, said filter comprising:

a filter member comprising an endless loop of air permeable material;

said filter member further comprising a first and second opening, each of said opening being manually manipulable to exteriorally embrace said suction portion of said fan and to leave said exhaust portion substantially open.

2. A filter as claimed in claim 1, wherein said fan presents a motor means and safety cage having an outer edge, and wherein each of said first and second opening presents a first and second perimetrical edge disposed opposite to one another, said first perimetrical edge adapted to embrace said outer edge, and said second perimetrical edge adapted to embrace said motor means adjacent to said safety cage.

3. A filter as claimed in claim 2, wherein each of said first and second perimetrical edge presents an elastic means.

4. A filter as claimed in claim 3, wherein said filter member defines two opposite ends connected to one another so as to present said first and second perimetrical edge.

5. A filter as claimed in claim 4 wherein said air permeable material is flexible.

6. A filter as claimed in claim 5, wherein said fan is a circular fan, and wherein said filter member is shaped to exteriorally embrace said safety cage of said circular fan and to leave said exhaust portion substantially open.

7. A filter as claimed in claim 6, wherein said circular fan includes a pedestal stand connected to said motor means, and said motor means is connected to said suction portion of said fan.

8. A filter as claimed in claim 7, wherein said first perimetrical edge is adapted to stretch over said safety cage and elastically embrace said outer edge, and said second perimetrical edge is adapted to elastically embrace said motor means adjacent to said safety cage, whereby said filter member elastically embraces said suction portion of said fan, and said exhaust portion is substantially open for free passage of air therethrough.

9. A filter for a circular fan having a safety cage, motor means and stand, and said safety cage presents a suction portion and outlet portion, wherein said suction portion comprises a first portion proximal to said motor means an second portion distal to said motor means, said fan comprising:

(a) an endless loop of air permeable material presenting two opposite ends connected to one another so as to define a first and second opening;

(b) elastic means associated with each said first and second opening;

whereby said air permeable material and said first and second openings are adapted to stretch over said fan, with said first opening elastically embracing said first portion of said suction portion of said fan and said other opening elastically embracing said second portion of said suction portion of said fan; and wherein said outlet portion is left substantially open.

10. A filter as claimed in claim 9 wherein both said openings stretch over said fan in a first stretched position to permit said filter to be mounted on said safety cage and in a second operable position in which said filter embraces said safety cage.

11. A filter as claimed in claim 10, wherein said fan creates in operation an air stream from said suction portion to said outlet portion, wherein said filter removes particulate material from said air stream in said second operable position, and wherein said outlet portion is left substantially open in said second operable position so as to allow free passage of said air stream through said outlet portion.

12. A filter as claimed in claim 11 wherein said openings are circular.

13. A filter as claimed in claim 12 wherein said openings have elastic material stitched to the periphery of said openings.

14. A filter for a fan having fan blades rotatively driven by a motor and a protective cage surrounding said fan blades comprising:

(a) an endless loop of air permeable material defining at opposite ends a first and second manipulable stretchable opening;

(b) said material and openings stretchable over said protective cage whereby said material is mounted about said cage on the intake side of said fan, and said first opening embraces an outer edge of said cage and said second opening embraces said motor, and the outtake side of said fan is left substantially open.

15. A filter as claimed in claim 14 wherein said air permeable material exhibits an air permeability of 880 cubic feet/square feet/minute.

16. A filter for a fan, said fan presenting a suction portion and outlet portion, said filter comprising:

a filter member comprising an endless web of air permeable material;

said filter member further comprising at least one opening, each said opening comprising a perimeter;

each of said perimeter comprising an elastic means;

said elastic means being manually manipulable to exteriorally embrace said suction portion of said fan and to leave said outlet portion substantially open.

* * * * *